US006764198B2

(12) United States Patent
Chang

(10) Patent No.: US 6,764,198 B2
(45) Date of Patent: Jul. 20, 2004

(54) ROTATABLY ADJUSTABLE REFLECTIVE MECHANISM FOR A STAGE LAMP

(76) Inventor: Ming-Cheng Chang, No. 10, Alley 48, Lane 5, Sheng Li Street, Yung Kang, Tainan Hsien (TW)

( * ) Notice: Subject to any disclaimer, the term of this patent is extended or adjusted under 35 U.S.C. 154(b) by 270 days.

(21) Appl. No.: 10/054,403

(22) Filed: Jan. 22, 2002

(65) Prior Publication Data

US 2003/0137842 A1 Jul. 24, 2003

(51) Int. Cl.[7] ..... F21V 21/15

(52) U.S. Cl. ..... 362/269; 362/271; 362/277; 362/282

(58) Field of Search ..... 362/3, 16, 18, 362/135, 142, 269, 271, 272, 273, 274, 277, 282, 284, 296, 306, 310, 317, 319, 322, 324, 382, 418, 419, 422, 423, 426

(56) References Cited

U.S. PATENT DOCUMENTS 2,909,652 A * 10/1959 Pratt ..... 362/284
4,663,698 A * 5/1987 Tomlinson ..... 362/284
4,769,743 A * 9/1988 Callahan ..... 362/284
6,220,727 B1 * 4/2001 Chang ..... 362/284
6,461,021 B1 * 10/2002 Warnecke ..... 362/282

* cited by examiner

*Primary Examiner*—Thomas M. Sember
*Assistant Examiner*—Ismael Negron
(74) *Attorney, Agent, or Firm*—Alan D. Kamrath; Nikolai & Mersereau, P.A.

(57) ABSTRACT

A reflective mechanism for a stage lamp providing an incident light includes a mounting device, a rotary device, a rotary frame, a reflective device rotatably mounted to the rotary frame, and a transmission device. The rotary device is mounted to the mounting device and comprises a fixed outer ring, a middle ring concentrically, rotatably mounted in the fixed outer ring, and an inner ring concentrically, rotatably mounted in the middle ring. The inner ring and the middle ring are driven by a first power device and a second power device, respectively. The rotary frame is attached to the middle ring to turn therewith. The transmission device includes a first transmission member mounted to the inner ring to turn therewith and a second transmission member that is mounted to the reflective device to turn therewith and that is connected to the first transmission member.

12 Claims, 9 Drawing Sheets

ROTATABLY ADJUSTABLE REFLECTIVE MECHANISM FOR A STAGE LAMP

BACKGROUND OF THE INVENTION

1. Field of the Invention

The present invention relates to a reflective mechanism for a computer-controlled stage lamp to provide more colorful light effect by means of providing a wider projection area.

2. Description of the Related Art

Sound effect and light effect are very important to stage performance. A good light effect provides a good background to the whole performance and makes the audience focus on the performer(s). A wide variety of stage lamps have heretofore been designed to provide desired light effect. A typical stage lamp, as shown in FIGS. 8 and 9 of the drawings, includes a computer-controlled lamp 8 with a light source (not shown) and a rotating disc (not shown) carrying various patterns thereon mounted in a casing 80 thereof. Light from the light source passes through a pattern on the rotating disc and a lens 81 and is thus incident to a reflective mechanism 9 from which the incident light is reflected, thereby providing colorful reflective images. The reflective mechanism 9 is mounted in a mounting section 82 of the casing 80 and includes a first motor 90 with an output shaft 901 extended through an inclined plate 83. A bracket 91 is securely attached to the output shaft 901 of the first motor 90 to rotate therewith. A second motor 92 is mounted to the bracket 91 and has an output shaft 921 to which a barrel 94 is mounted. A cylindrical mirror 941 (consisting of a plurality of mirror strips) is mounted to an outer periphery of the barrel 94 for reflecting incident light from the lens 81. The inclined plate 83 includes an opening 84 through which a wire 93 extends so as to be electrically connected to the second motor 92 for supplying power to the second motor 92. The output shaft 901 of the first motor 90 rotates about an axis X, and the output shaft 921 of the second motor 92 rotates about another axis Y that is perpendicular to the axis X. Thus, the barrel 94 with the cylindrical mirror 941 is expected to rotate universally such that the light, after passing through the lens 81, may be reflected by the mirror 941 to provide varying three-dimensional light images.

Nevertheless, the area of the projected light reflected by the barrel 94 is somewhat narrow as being limited by the U-shaped mounting area 82 of the casing 80.

The present invention is intended to provide an improved reflective mechanism to solve this problem.

SUMMARY OF THE INVENTION

It is a primary object of the present invention to provide a reflective mechanism for a computer-controlled stage lamp that provides more colorful light effect by means of providing a wider projection area.

In accordance with the present invention, a reflective mechanism is provided for a stage lamp providing an incident light. The reflective mechanism comprises:

a mounting device comprising a main plate having a hole through which an incident light from a stage lamp passes;

a first power device;

a second power device;

a rotary device mounted to the mounting device, the rotary device comprising a fixed outer ring, a middle ring concentrically, rotatably mounted in the fixed outer ring, and an inner ring concentrically, rotatably mounted in the middle ring, the inner ring of the rotary device defining a light passage through which the incident light passes, the inner ring being connected to and thus drivable by the first power device, the middle ring being connected to and thus drivable by the second power device;

a rotary frame securely attached to the middle ring to turn therewith, the rotary frame including a hole through which the incident light passes;

a reflective device comprising a mirror frame rotatably mounted to the rotary frame and a mirror means mounted to the mirror frame for reflecting the incident light passing through the hole of the rotary frame; and a transmission device including a first transmission member securely mounted to the inner ring to turn therewith, the transmission device further including a second transmission member securely mounted to the mirror frame to turn therewith, the second transmission member being connected to the first transmission member.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
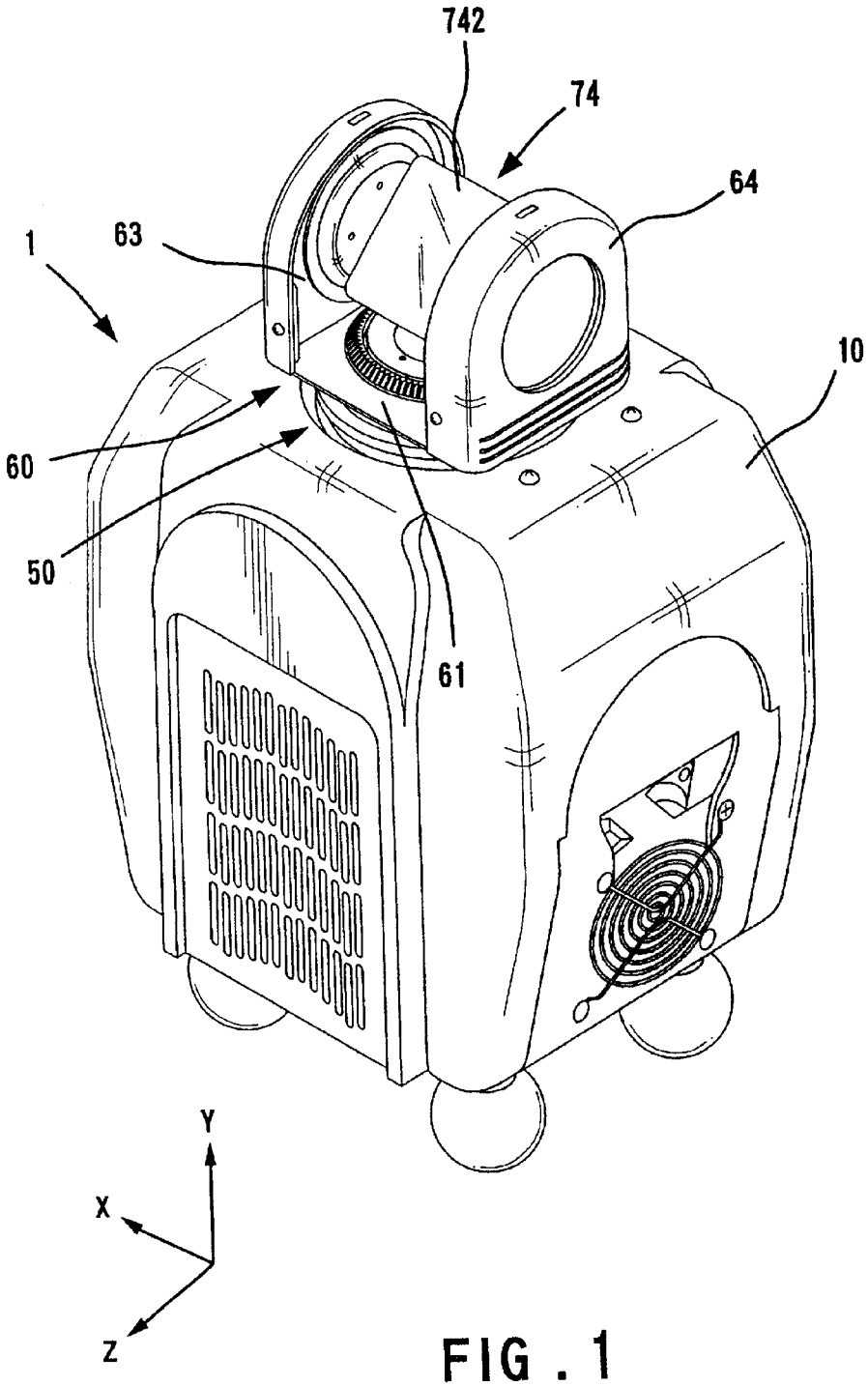
FIG. 1 is a perspective view of a computer-controlled stage lamp with a reflective mechanism in accordance with the present invention.
Figure 2:
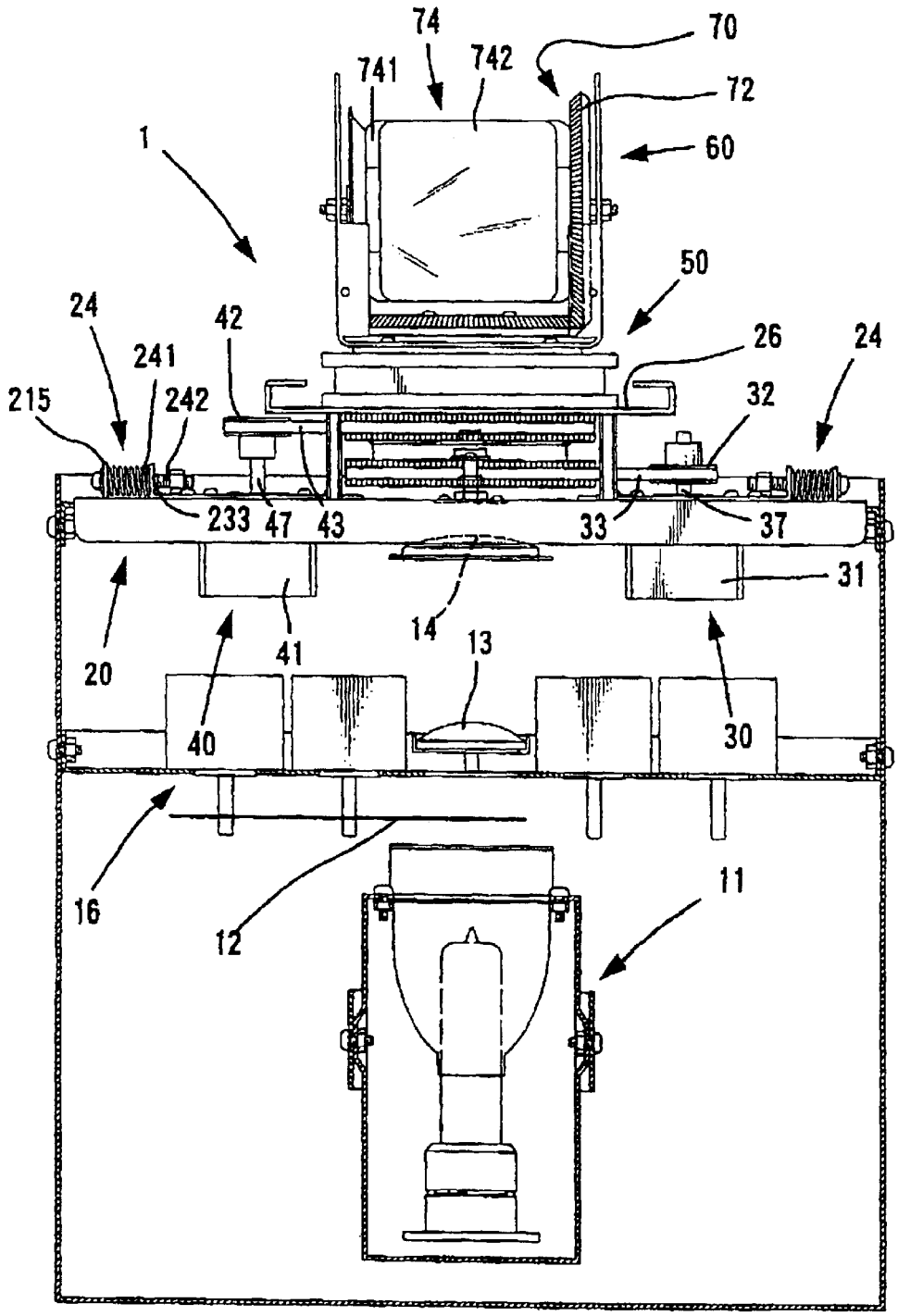
FIG. 2 is a sectional view of the computer-controlled stage lamp in accordance with the present invention, wherein a casing of the computer-controlled stage lamp is removed for clarity.

Referring to FIGS. 1 through 7 and initially to FIGS. 1 and 2, a reflective mechanism in accordance with the present invention is mounted in a casing 10 (FIG. 1) of a computer-controlled lamp 1. As illustrated in FIG. 2, the computer-controlled lamp 1 generally includes a light source 11, a rotational disc 12 carrying colorful patterns thereon, a fixed lens 13, and a movable lens 14 that can be moved relative to the fixed lens 13. The rotational disc 12 is mounted to an output shaft (not labeled) of a motor unit 16 in the casing 10. Thus, light from the light source 11 passes through the pattern on the rotational disc 12 and the lenses 13 and 14 and is then incident to the reflective mechanism that reflects the incident light to the stage.

Figure 4:
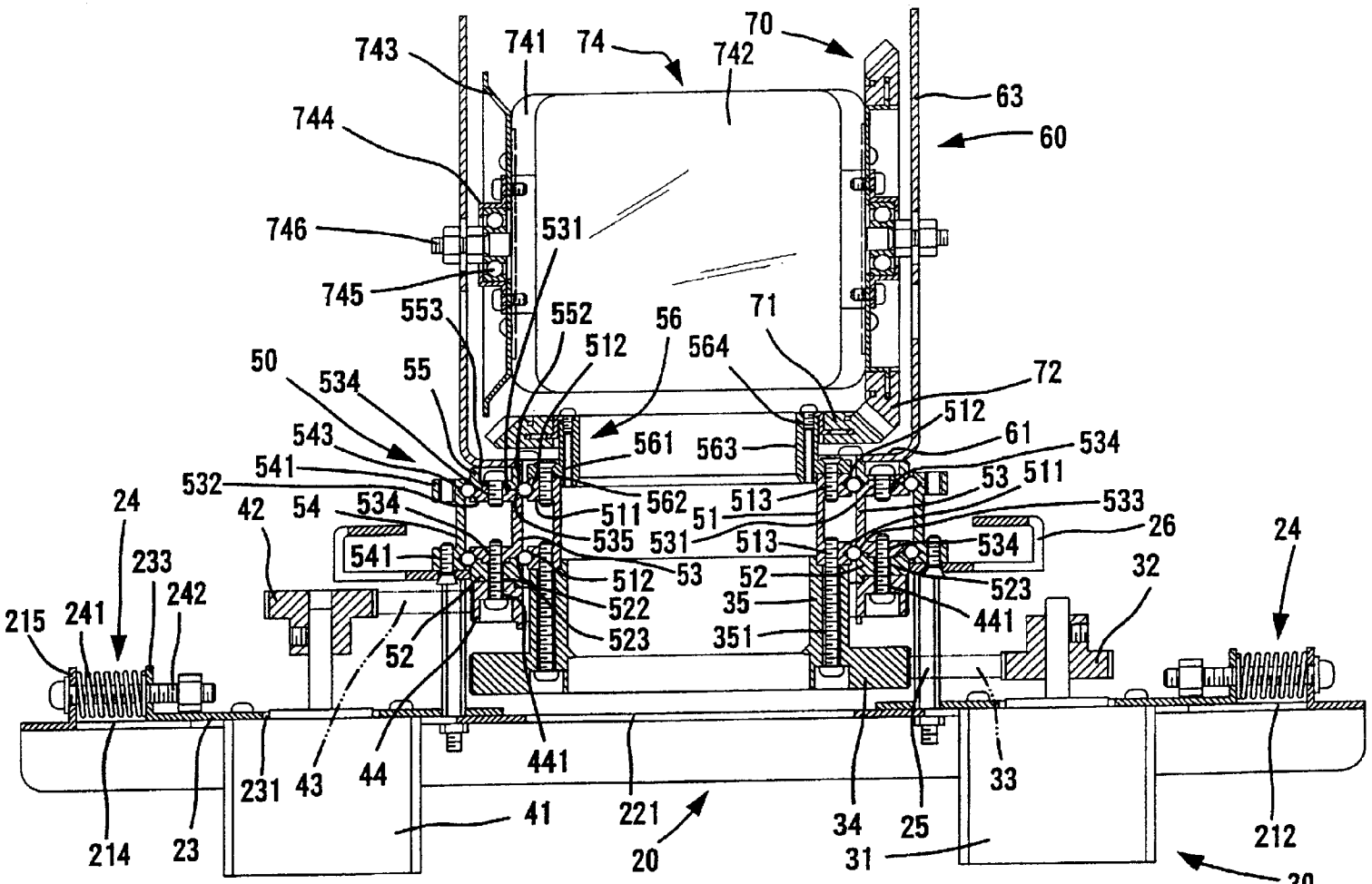
FIG. 4 is a sectional view taken along plane 4—4 in FIG. 3.
Figure 5:
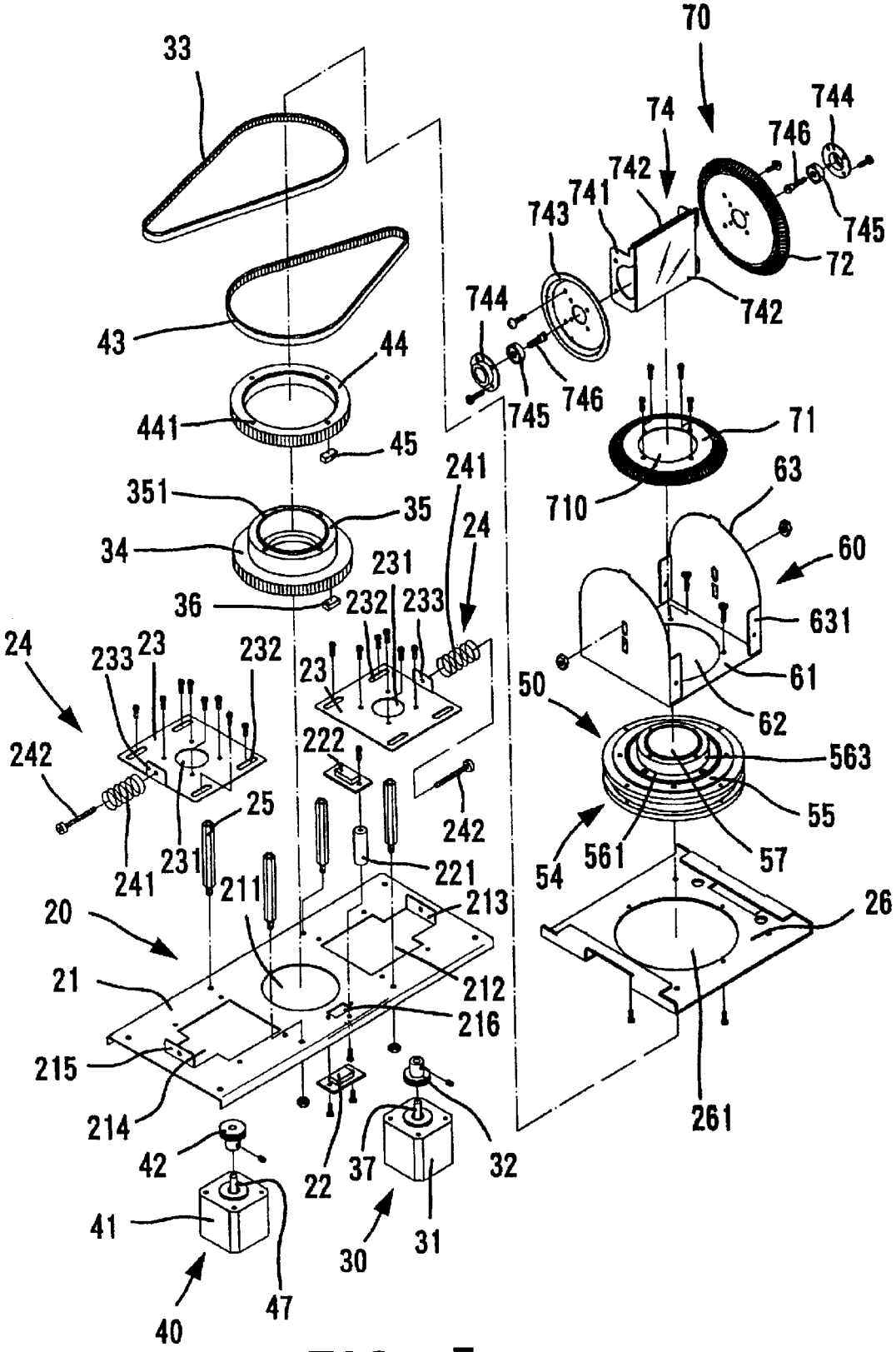
FIG. 5 is an exploded perspective view of the reflective mechanism of the computer-controlled stage lamp in accordance with the present invention.

The reflective mechanism in accordance with the present invention comprises a mounting device 20, a first power device 30, a second power device 40, a rotary device 50, a rotary frame 60, a transmission device 70, and a reflective device 74. As illustrated in FIGS. 2, 4, and 5, the mounting device 20 comprises a main plate 21 that is fixed to the casing 10, two positioning plates 23, and a mounting plate 26. The main plate 21 includes a hole 211 in a central portion thereof and two openings 212 and 214 on both sides of the hole 211. A stop plate 213, 215 projects upward from a portion of a periphery defining each opening 212, 214. Each positioning plate 23 is fixed by screws (not labeled) above an associated one of the openings 212 and 214 and includes a through-hole 231 communicated with the opening 212, 214 and plural adjusting slots 232. Each positioning plate 23 farther includes a stop plate 233 formed thereon. Screws (not labeled) are extended through the adjusting slots 232 and fixing holes (not labeled) in the main plate 21 to thereby secure the positioning plates 23 in place.

Figure 3:
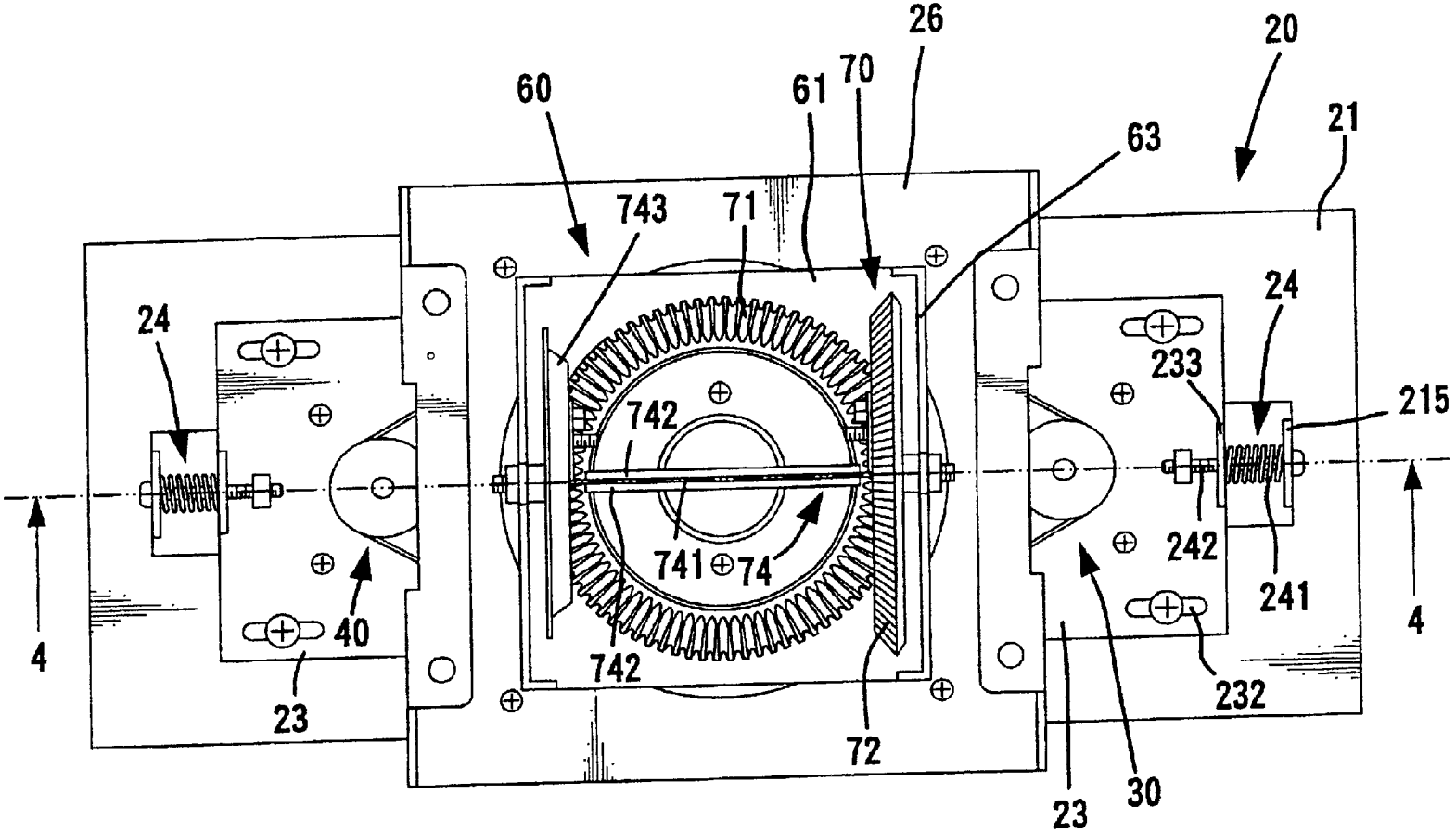
FIG. 3 is a top view of the reflective mechanism of the computer-controlled stage lamp in accordance with the present invention.

Referring to FIGS. 3, 4, and 5, a hole 216 (a rectangular one in this embodiment) is defined in the main plate 21 and located adjacent to the hole 211. A sensor 22 is mounted to an underside of the main plate 21 and in alignment with the hole 216. A rod 221 is mounted to an upper side of the main plate 21, and a sensor 222 is secured to an upper end of the rod 221.

Still referring to FIGS. 3, 4, and 5, a damping device 24 is mounted between the stop plate 233 of each positioning plate 23 and the associated stop plate 213, 215 on the main plate 21 for absorbing vibration resulting from operation of the first and second power devices 30 and 40. In this embodiment, each damping device 24 includes a screw 242 secured to the stop plates 233 and a spring 241 mounted around the screw 242 and attached between the stop plates 233 and 213; 233 and 215.

Still referring to FIGS. 3, 4, and 5, plural positioning rods 25 are mounted on the upper side of the main plate 21 for mounting the mounting plate 26 to the main plate 21, the mounting plate 26 having a hole 261 in which the rotary device 50 is mounted.

Still referring to FIGS. 2, 3, 4, and 5, the first power device 30 and the second power device 40 are mounted to the main plate 21 of the mounting device 20. The first power device 30 includes a motor 31 having an output shaft 37 to which a gear 32 is securely mounted to turn therewith. The motor 31 is mounted to the underside of the main plate 21 with the output shaft 37 extending through the through-hole 231 of the associated positioning plate 23. The second power device 40 includes a motor 41 having an output shaft 47 to which a gear 42 is securely mounted to turn therewith. The motor 41 is mounted to the underside of the main plate 21 with the output shaft 37 extending through the through-hole 231 of the associated positioning plate 23, best shown in FIG. 2.

The first power device 30 further includes a gear 34 having a boss 35, plural holes 351 being defined in an end face of the boss 35. A belt 33 is mounted around the gears 32 and 34 such that the gear 34 turns when the motor 31 turns. The second power device 40 further includes a gear 44 having plural transverse holes 441. A belt 43 is mounted around the gears 42 and 44 such that the gear 44 turns when the motor 41 turns. The gears 34 and 44 are mounted below the rotary device 50 with the gear 44 rotatably mounted around the boss 35, best shown in FIGS. 2 and 4.

Referring to FIGS. 4 and 5, a magnetic element 36 is mounted to a side of the gear 34, and a magnetic element 45 is mounted to a side of the gear 44. Each magnetic element 36, 45 is detected by an associated one of the sensors 22 and 222 to thereby detect the position of the gear 34, 44, thereby providing a zeroing function at the beginning of starting of the motors 31 and 41.

Figure 6:
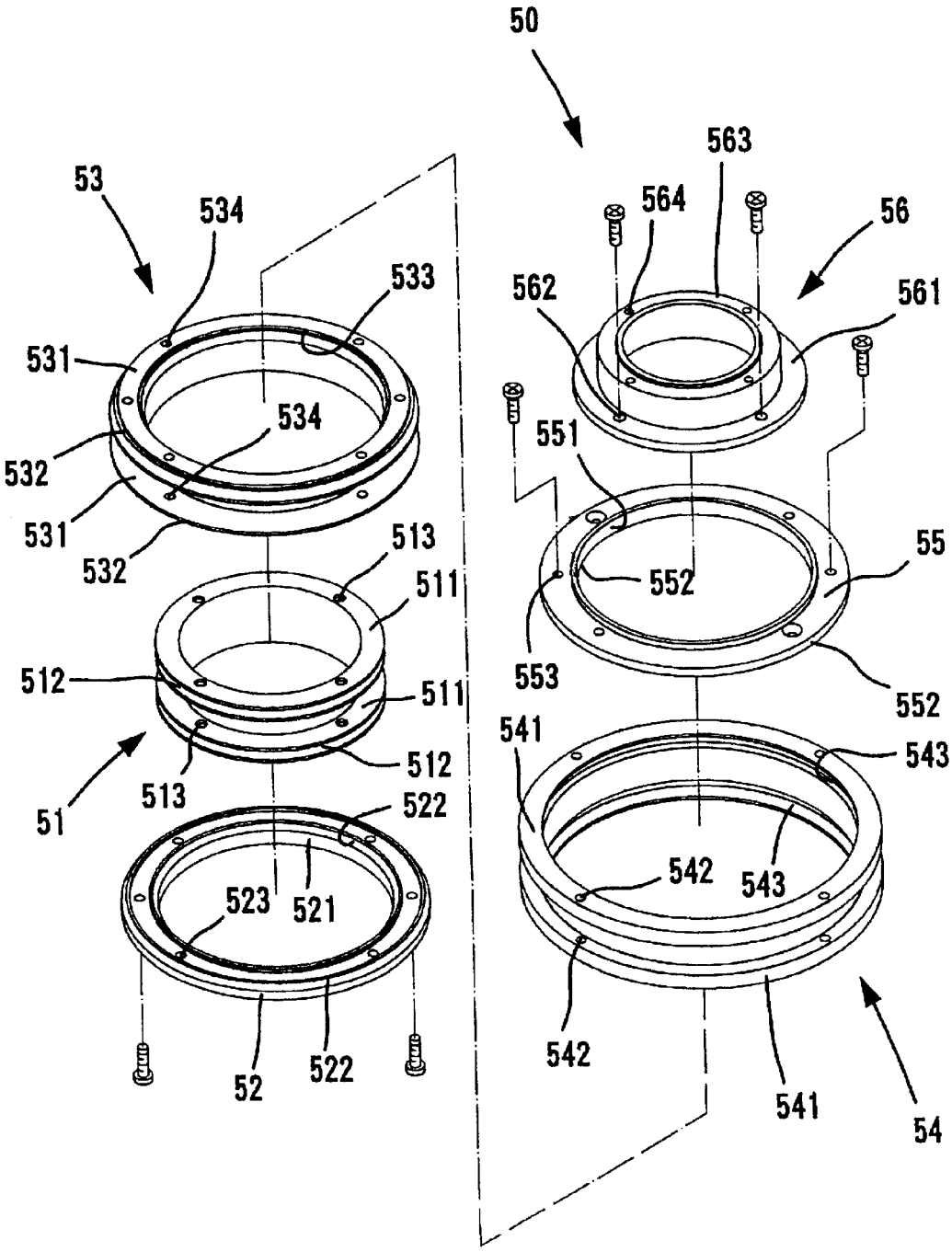
FIG. 6 is an exploded perspective view of a rotary device of the reflective mechanism in accordance with the present invention.

Referring to FIGS. 4, 5, and 6, the rotary device 50 includes an inner ring 51, a first lining ring 52, a middle ring 53, an outer ring 54, a second lining ring 55, and a positioning ring 56. The inner ring 51 includes two spaced flanges 511 formed on an outer periphery thereof and extending along the outer periphery. Each flange 511 includes an annular groove 512 for receiving balls (not labeled), thereby allowing relative smooth rotation between the inner ring 51 and the middle ring 53 that is concentrically mounted around the inner ring 51. Transverse screw holes 513 are defined in each flange 511. The inner ring 51 is coaxially mounted on top of the boss 35 of the gear 34, and screws (not labeled) are extended through the holes 351 of the boss 35 and the transverse screw holes 513 of a lower one of the flanges 511.

The positioning ring 56 is securely mounted on top of the inner ring 51 to turn therewith. The positioning ring 56 is a ring 561 including a boss 563 on a side thereof. Plural screw holes 563 are defined in an end face of the boss 563. Further, plural screw holes 562 are defined in the ring 561 and located around the boss 563. The ring 561 is concentrically attached to an upper one of the flanges 511 of the inner ring 51, and screws (not labeled) are extended through the screw holes 562 of the ring 561 and the screw holes 513 of the upper one of the flanges 511. Thus, when the first power device 30 is activated to turn the gear 34, the inner ring 51 and the positioning ring 56 are also turned.

Referring to FIGS. 4 and 6, the middle ring 53 is concentrically mounted between the inner ring 51 and the outer ring 54 and includes two spaced flanges 531. The first lining ring 52 and the second lining ring 55 are respectively, securely attached to the flanges 531 of the middle ring 53. Each flange 511 of the middle ring 53 includes an inner annular beveled face 533 and an outer annular beveled face 532. Each of the first lining ring 52 and the second lining ring 55 includes plural holes 523, 553 and a boss 521, 551 having an annular beveled face 522, 552. The first lining ring 52 has a lower side abutting against the upper side of the gear 44, and screws (not labeled) are extended through the holes 441 of the gear 44, the holes 523, 553 of the respective lining ring 52, 55 and the screw holes 534 in the respective flange 511. Thus, the gear 44, the middle ring 53, and the lining rings 52 and 55 turn jointly when the second power device 40 is activated. Preferably, the first lining ring 52 is coaxially mounted to the gear 44.

As illustrated in FIGS. 4 and 6, the outer ring 54 includes upper and lower flanges 541 each having plural screw holes 542 defined therein. Two annular grooves 543 are defined in an inner periphery of the outer ring 54 for receiving balls (not labeled). The outer ring 54 has a lower side resting on the mounting plate 26, and screws (not labeled) are extended through the mounting plate 26 and screw holes 542 of the lower flange 541, thereby fixing the outer ring 54 to the mounting plate 26.

Still referring to FIGS. 4 and 6, the gear 44, the first lining ring 52, the middle ring 53, and the second lining ring 55 are concentrically mounted in the outer ring 54. Balls (not labeled) are mounted in the annular grooves 543 and located between the annular beveled faces 552 and 535. Further balls (not labeled) are mounted in the annular grooves 543 and located between the annular beveled faces 532 and 522. Thus, the gear 44, the first lining ring 52, the middle ring 53, and the second lining ring 55 turns jointly when the second power device 40 is activated. And the gear 34, the inner ring 51, and the positioning ring 56 turns jointly when the first power device 30 is activated.

Referring to FIGS. 2, 3, 4, and 5, the rotary frame 60 includes a bottom plate 61 having a hole 62 and two opposite wings 63 on the bottom plate 61. Each wing 63 includes a pair of guide plates 631 on both sides thereof for mounting a protective cover 64 (FIG. 1). The rotary frame 60 is mounted on top of the rotary device 50 with the positioning ring 56 being located in the hole 62 of the bottom plate 61 and with the boss 563 of the positioning ring 56 extending beyond the hole 62 of the bottom plate 61. In addition, the bottom plate 61 abuts against the second lining ring 55, and screws (not labeled) are extended through the bottom plate 61 into the screw holes 553 of the second lining ring 55. Thus, the rotary frame 60 turns together with the gear 44, the lining rings 52 and 55, and the middle ring 53 when the second power device 40 is activated.

The transmission device 70 turns when the positioning ring 56 turns. The transmission device 70 includes a first bevel gear 71 and a second bevel gear 72 meshed with the first bevel gear 71. The first bevel gear 71 is mounted on top of the boss 563 of the positioning ring 56. Screws (not labeled) are extended through holes (not labeled) in an inner side of the first bevel gear 71 and the screw holes 564 of the boss 563. The first bevel gear 71 includes a central opening 710.

The reflective mechanism 74 is rotatably mounted between the wings 63 of the rotary frame 60 and includes a substantially U-shaped mirror frame 741 and two mirrors 742 mounted to both sides of a middle portion of the mirror frame 741. A side plate 743 is securely attached to one of two limbs of the U-shaped mirror frame 741 and the second bevel gear 72 is securely attached to the other limb of the U-shaped mirror frame 741. A bearing seat 744 is mounted to a side of the side plate 743 for mounting a bearing 745. An axle 746 is extended through the bearing 745 and one of the wings 63 of the rotary frame 60 and then engaged with a nut (not labeled). Similarly, another bearing seat 744 is mounted to a side of the second bevel gear 72 for receiving another bearing 745. Another axle 746 is extended through the bearing 745 and the other wing 63 of the rotary frame 60 and then engaged with another nut (not labeled). Thus, the second bevel gear 72, the mirror frame 741, and the side plate 743 are secured together as a unit rotatably held between the wings 63 of the rotary frame 60. When the first power device 30 is activated, the mirror frame 741 of the reflective device 74 is turned via transmission of the gear 34, the inner ring 51, the positioning ring 56, and the bevel gears 71 and 72 of the transmission device 70. When the second power device 40 is activated, the mirror frame 741 of the reflective device 74 is turned via transmission of the gear 44, the first lining ring 52, the middle ring 53, the second lining ring 55, the rotary frame 60, and the second bevel gear 72.

Figure 7:
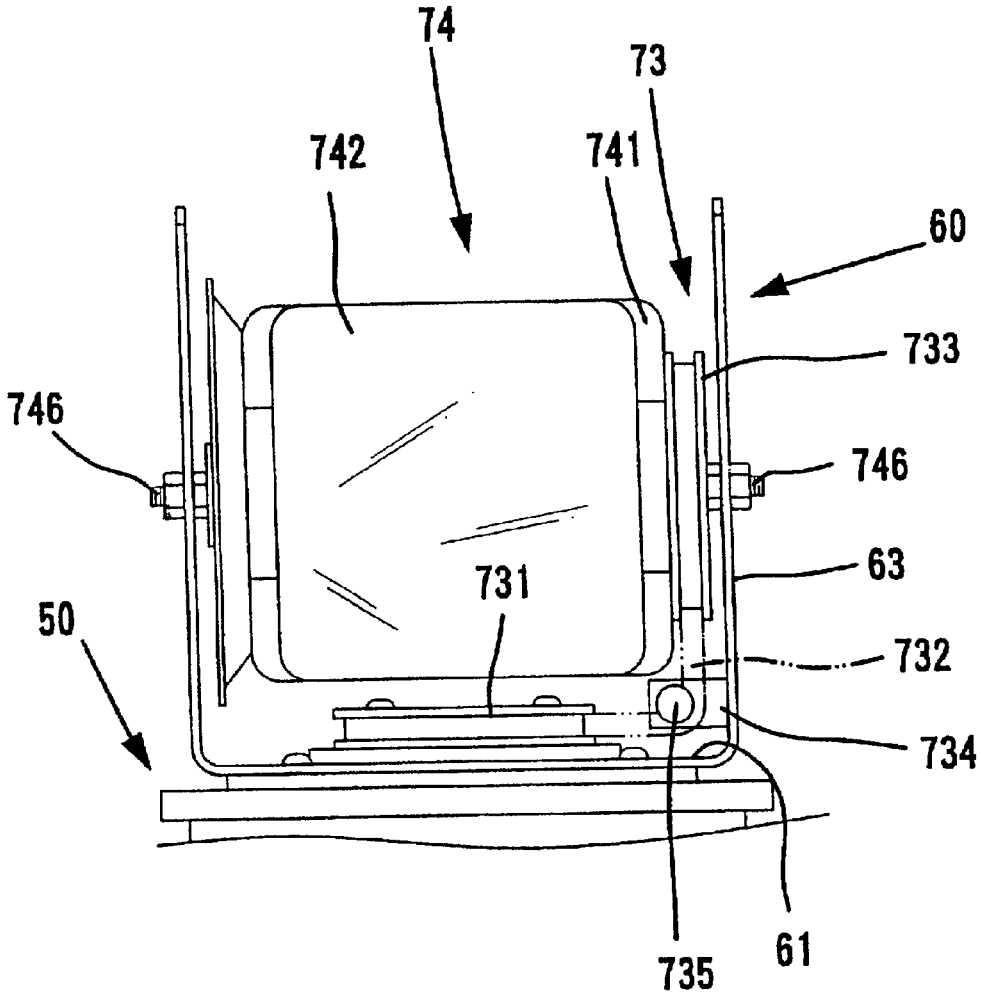
FIG. 7 is a side view of a rotary frame and a transmission device of a modified embodiment of the reflective mechanism in accordance with the present invention.
Figure 8:
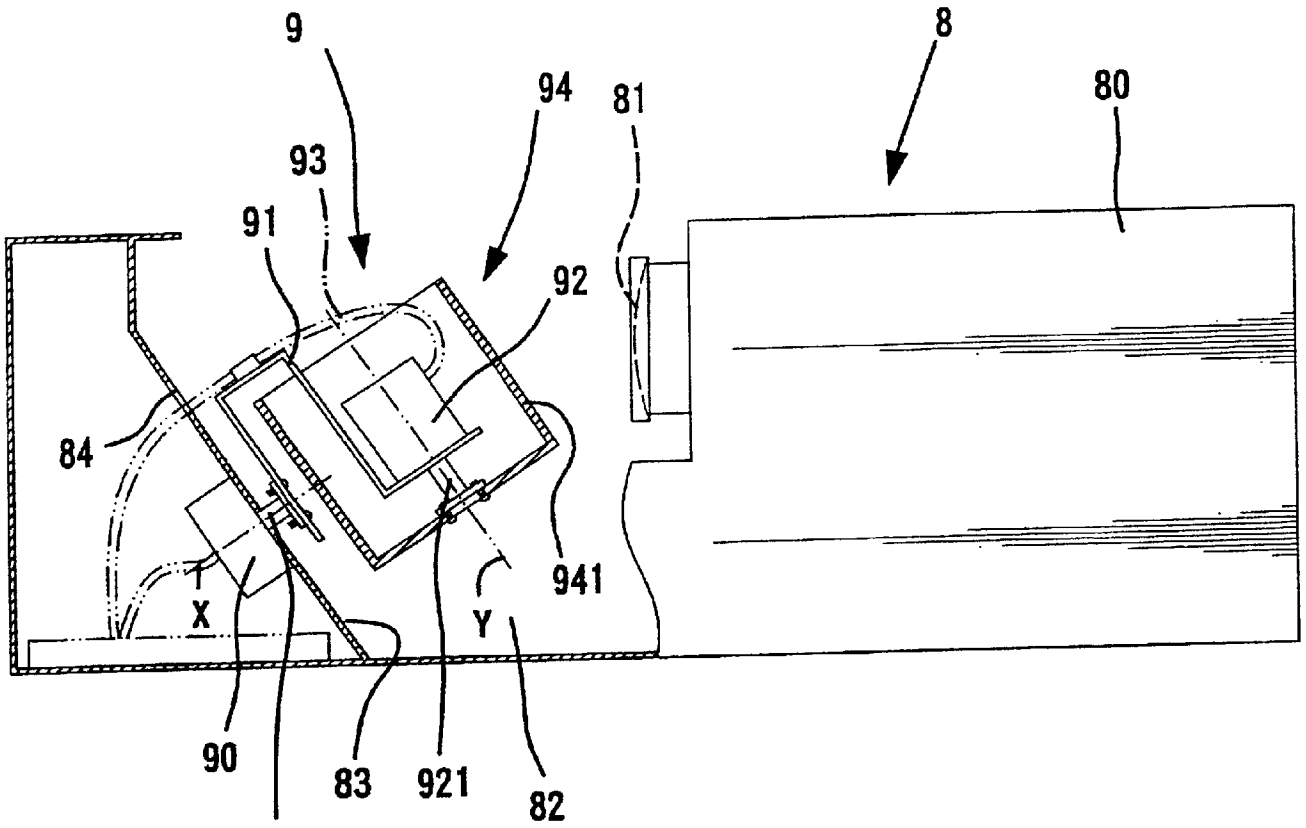
FIG. 8 PRIOR ART
FIG. 8 is a side view, partly sectioned, of a computer-controlled stage lamp with a conventional reflective mechanism.
Figure 9:
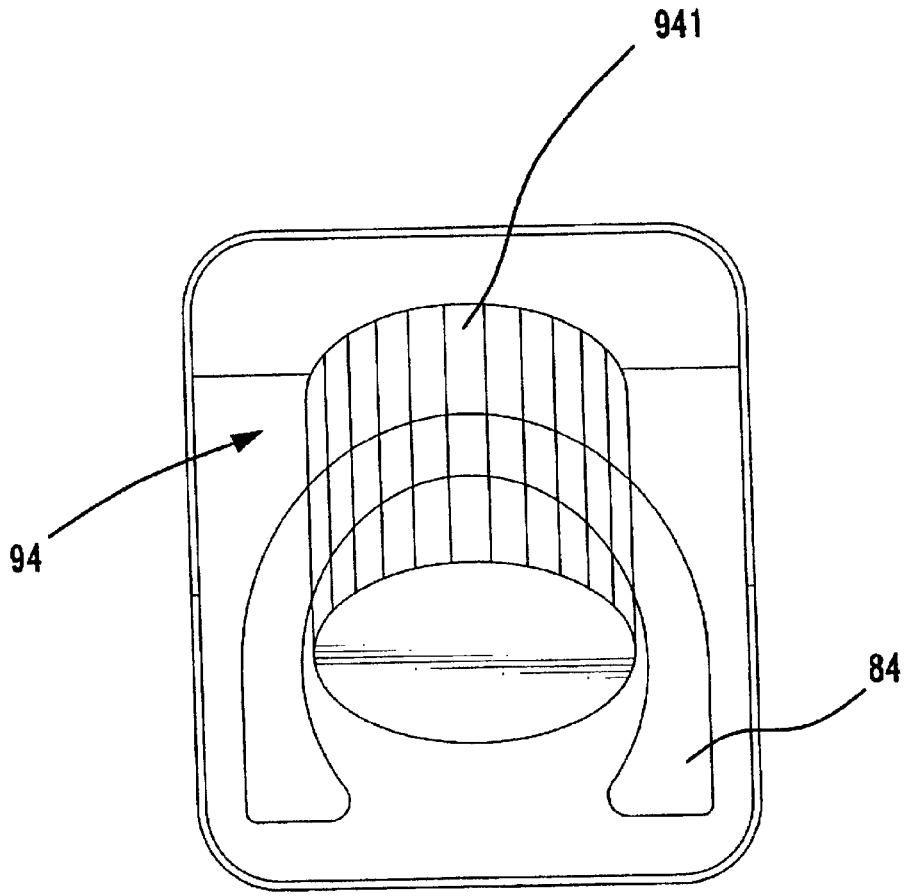
FIG. 9 PRIOR ART
FIG. 9 is a top view, partly sectioned, of a portion of the conventional reflective mechanism in FIG. 8.

FIG. 7 illustrates a modified embodiment of the transmission device (now designated by 73) for driving the reflective mechanism 74. The transmission device 73 includes a rotational wheel 731 securely mounted on the boss 563 of the positioning ring 56, and a bracket 734 is attached to one of the wings 63. A guide wheel 735 is rotatably mounted to the bracket 734. A rotational wheel 733 is mounted to one of the limbs of the mirror frame 741. A belt 732 is mounted around the rotational wheels 733 and the guide wheel 735. Thus, the mirror frame 741 of the reflective device 74 is turned via transmission of the rotational wheels 731 and 733 when the positioning ring 56 is turned.

According to the above description, it is appreciated that the light from the light source 11 passes through the pattern on the rotational disc 12 and the lenses 13 and 14, a light passage 57 (FIG. 5) defined in a central portion of the rotary device 50, the hole 62 of the rotary frame 60, and a central hole 710 in the first bevel gear 71, and is then incident to the mirror 742 of the reflective device 74 that reflects the incident light to the stage. When the first power device 30 is activated, the first gear 34, the inner ring 51, and the positioning ring 56 are also turned to thereby drive the mirror frame 741 via transmission of the bevel gears 71 and 72. Thus, the mirror frame 741 may turn through 360° about an axis X (FIG. 1). When the second power device 40 is activated, the gear 44, the first lining ring 52, the middle ring 53, and the second lining ring 55 are turned to thereby drive the rotary frame 60 to turn through 360° about an axis Y (FIG. 1). A more colorful projection effect with numerous possible combinations can be obtained. Further, when the mirror frame 741 is turned by the transmission device 70, at the moment that the mirror frame 741 lies in a vertical plane, the projected light is reflected upward along the vertical direction (Z axis, FIG. 1) by the reflective device 74. The projected light images are thus more colorful, as a universal projection is obtained and the projection area is increased. A fabulously beautiful colorful projection effect can be obtained accordingly.

Although the invention has been explained in relation to its preferred embodiment, it is to be understood that many other possible modifications and variations can be made without departing from the spirit and scope of the invention as hereinafter claimed.

What is claimed is:

1. A reflective mechanism for a stage lamp providing an incident light, the reflective mechanism comprising:

a mounting device comprising a main plate having a hole through which an incident light from a stage lamp passes;

a first power device;

a second power device;

a rotary device mounted to the mounting device, the rotary device comprising a fixed outer ring, a middle ring concentrically, rotatably mounted in the fixed outer ring, and an inner ring concentrically, rotatably mounted in the middle ring, the inner ring of the rotary device defining a light passage through which the incident light passes, the inner ring being connected to and thus drivable by the first power device, the middle ring being connected to and thus drivable by the second power device;

a rotary frame securely attached to the middle ring to turn therewith, the rotary frame including a hole through which the incident light passes;

a reflective device comprising a mirror frame rotatably mounted to the rotary frame and a mirror means mounted to the mirror frame for reflecting the incident light passing through the hole of the rotary frame; and a transmission device including a first transmission member securely mounted to the inner ring to turn therewith, the transmission device further including a second transmission member securely mounted to the mirror frame to turn therewith, the second transmission member being connected to the first transmission member.

2. The reflective mechanism as claimed in claim 1, further comprising a first sensor and a second sensor mounted to the main plate, a first magnetic element being mounted to the third gear, a second magnetic element being mounted to the fourth gear, the first sensor detecting a position of the first magnetic element to thereby detect a position of the third gear, thereby providing a zeroing function for the third gear, the second sensor detecting a position of the second magnetic element to thereby detect a position of the fourth gear, thereby providing a zeroing function for the fourth gear.

3. The reflective mechanism as claimed in claim 1, further comprising plural positioning rods securely mounted to the main plate, a mounting plate being securely mounted to said plural positioning rods and including a hole aligned with the hole of the main plate and the hole of the rotary frame, the outer ring of the rotary device being securely mounted to the mounting plate with the light passage aligning with the hole of the mounting plate.

4. The reflective mechanism as claimed in claim 1, wherein the first transmission member is a first bevel gear and the second transmission member is a second bevel gear meshed with the first bevel gear.

5. The reflective mechanism as claimed in claim 1, wherein the first transmission member is a first rotational wheel and the second transmission member is a second rotational wheel, further comprising a bracket securely mounted to the rotary frame, a guide wheel being rotatably mounted to the bracket, a belt being mounted around the first rotational wheel, the guide wheel, and the second rotational wheel.

6. The reflective mechanism as claimed in claim 1, further comprising a damping device mounted to the main plate for absorbing vibrations as a result of operation of the first power device and the second power device.

7. The reflective mechanism as claimed in claim 6, further comprising two positioning plates securely mounted to the main plate, each said positioning plate including a first stop plate, the main plate including two second stop plates, said damping device including a screw secured to a respective said first stop plate and a respective said second stop plate, said damping device further including a spring mounted around the screw and attached between the respective first stop plate and the respective second stop plate.

8. The reflective mechanism as claimed in claim 1, wherein the first power device comprises a first motor having an output shaft, a first gear being securely mounted to the output shaft of the first motor to turn therewith, the second power device comprising a second motor having an output shaft, a second gear being securely mounted to the output shaft of the second motor to turn therewith.

9. The reflective mechanism as claimed in claim 8, wherein the first power device further comprises a third gear coaxially, securely mounted to the inner ring to turn therewith, the third gear being connected to and thus driven by the first gear of the first motor, the second power device further comprising a fourth gear coaxially, securely mounted to the middle ring to turn therewith, the fourth gear being connected to and thus driven by the second gear of the second motor.

10. The reflective mechanism as claimed in claim 9, wherein the first gear and the third gear are connected by a belt.

11. The reflective mechanism as claimed in claim 9 wherein the third gear and the fourth gear are connected by a belt.

12. A reflective mechanism for a stage lamp providing an incident light, the reflective mechanism comprising:

a mounting device comprising a main plate having a hole through which an incident light from a stage lamp passes;

a first power device mounted to the main plate;

a second power device mounted to the main plate;

a rotary device mounted to the mounting device, the rotary device comprising a fixed outer ring, a first lining ring, a middle ring concentrically, rotatably mounted in the fixed outer ring, a second lining ring, an inner ring concentrically, rotatably mounted in the middle ring, and a positioning ring, the inner ring of the rotary device defining a light passage through which the incident light passes, the inner ring having a first side connected to and thus drivable by the first power device and a second side, the first lining ring being securely attached to a side of the middle ring to turn therewith, the first lining ring being connected to and thus drivable by the second power device, the second lining ring being securely attached to another side of the middle ring to turn therewith, the positioning ring being securely attached to the second side of the inner ring to turn therewith;

a rotary frame securely attached to the second lining ring to turn therewith, the rotary frame including a hole through which the incident light passes;

a reflective device comprising a mirror frame rotatably mounted to the rotary frame and a mirror means mounted to the mirror frame for reflecting the incident light passing through the hole of the rotary device; and a transmission device including a first transmission member securely mounted to the positioning ring to turn therewith, the transmission device further including a second transmission member securely mounted to the mirror frame to turn therewith, the second transmission member being connected to the first transmission member.

* * * * *